US011085732B2

(12) United States Patent
Guillerm et al.

(10) Patent No.: US 11,085,732 B2
(45) Date of Patent: Aug. 10, 2021

(54) ARTICULATED STOCK FOR SHOULDER-FIRED WEAPON

(71) Applicants: Gaël Guillerm, Pont-Scorff (FR); Johann Gautier, Caudan (FR)

(72) Inventors: Gaël Guillerm, Pont-Scorff (FR); Johann Gautier, Caudan (FR)

( * ) Notice: Subject to any disclaimer, the term of this patent is extended or adjusted under 35 U.S.C. 154(b) by 182 days.

(21) Appl. No.: 16/464,434

(22) PCT Filed: Dec. 13, 2017

(86) PCT No.: PCT/EP2017/082565
§ 371 (c)(1),
(2) Date: May 28, 2019

(87) PCT Pub. No.: WO2018/108982
PCT Pub. Date: Jun. 21, 2018

(65) Prior Publication Data

US 2021/0116210 A1 Apr. 22, 2021

(30) Foreign Application Priority Data

Dec. 13, 2016 (FR) ..... 1670758

(51) Int. Cl.
*F41C 23/14* (2006.01)
*F41C 23/20* (2006.01)

(52) U.S. Cl.
CPC ..... *F41C 23/14* (2013.01); *F41C 23/20* (2013.01)

(58) Field of Classification Search
CPC ..... F41C 23/14; F41C 23/20
USPC ..... 42/73
See application file for complete search history.

(56) References Cited

U.S. PATENT DOCUMENTS 243,553 A * 6/1881 Hape ..... F41C 23/14 42/73
287,741 A * 10/1883 Vickers, Jr. ..... F41C 23/04 42/72
555,602 A * 3/1896 Foulkrod ..... F41C 23/14 42/73

(Continued)

FOREIGN PATENT DOCUMENTS

DE 82382 8/1895
DE 3631391 A1 3/1988

(Continued)

OTHER PUBLICATIONS

International Search Report corresponding International application PCT/EP2017/082565 dated Mar. 15, 2018, 3 pages.

*Primary Examiner* — Joshua E Freeman
(74) *Attorney, Agent, or Firm* — Cooper Legal Group, LLC; Ronald M. Kachmarik

(57) ABSTRACT

A stock for a shoulder-fired weapon. The stock includes an articulated trapezoid or parallelogram-shaped structure that includes two blocks respectively forming a rest interface with the body of the weapon and a support for a butt plate, and at least two rigid linking arms, each jointed, at one of its ends, by a pivot link with the rest interface with the body of the weapon and at the other of its ends by a pivot link with the support of the butt plate. The weapon includes at least one locking structure for locking the arms together, in at least one fixed position defining a desired height of the butt plate with respect to the rest interface.

14 Claims, 4 Drawing Sheets

(56) References Cited

U.S. PATENT DOCUMENTS 628,360 A * 7/1899 Scripture ..... F41C 23/14 42/73
669,871 A * 3/1901 Zoeller ..... F41C 23/14 42/73
729,030 A * 5/1903 Yount ..... F41C 23/14 42/73
824,505 A * 6/1906 Munson ..... F41C 23/14 42/73
842,436 A * 1/1907 Thomas ..... F41C 23/14 42/73
843,227 A * 2/1907 Munson ..... F41C 23/14 42/73
855,229 A * 5/1907 Clarisey ..... F41C 23/14 42/73
1,063,061 A * 5/1913 Pickering ..... F41C 23/14 42/73
1,088,362 A * 2/1914 Perkins ..... F41C 23/20 42/73
1,222,778 A * 4/1917 McCleary ..... F41A 19/09 42/73
1,248,029 A * 11/1917 Snedecor ..... F41C 23/14 42/73
1,384,386 A * 7/1921 Green ..... F41C 23/00 42/72
1,468,354 A * 9/1923 Caretto ..... F41C 23/14 42/74
1,582,395 A * 4/1926 Haemmerli ..... F41C 23/14 42/73
1,651,299 A * 11/1927 Stansel ..... F41C 23/14 42/73
4,271,623 A * 6/1981 Beretta ..... F41C 23/12 42/71.02
4,513,523 A * 4/1985 Gal ..... F41C 23/04 42/72
4,735,007 A * 4/1988 Gal ..... F41C 23/04 42/7
6,901,691 B1 * 6/2005 Little ..... F41A 23/02 42/118
8,819,981 B2 * 9/2014 Malik ..... F41C 23/04 42/73
8,844,185 B2 * 9/2014 Jarboe ..... F41C 23/14 42/73
8,910,407 B2 * 12/2014 Singh ..... F41C 23/12 42/71.02
9,488,434 B2 * 11/2016 Kielsmeier ..... F41C 23/20
9,829,272 B2 * 11/2017 Brown ..... F41C 23/10
10,514,231 B1 * 12/2019 Hovey ..... F41C 23/20
2007/0245524 A1 * 10/2007 Hsu ..... F16M 11/2021 16/366
2008/0000132 A1 1/2008 Orvis
2012/0137562 A1 * 6/2012 Langevin ..... F41C 23/14 42/75.03
2013/0036645 A1 * 2/2013 Chvala ..... F41C 23/04 42/73
2013/0212920 A1 * 8/2013 Law ..... F41C 23/04 42/75.03
2014/0331539 A1 * 11/2014 Malik ..... F41C 23/04 42/73
2015/0013203 A1 * 1/2015 Lopiccolo ..... F41C 23/04 42/73
2018/0180378 A1 * 6/2018 Pretelli ..... F41A 11/02
2019/0323795 A1 * 10/2019 Zimmer ..... F41C 23/04
2020/0149840 A1 * 5/2020 Schoenborn ..... F41C 23/14

FOREIGN PATENT DOCUMENTS

EP 1126321 B1 12/2006
EP 2988087 A1 2/2016
FR 679450 A 4/1930
FR 735860 11/1932

* cited by examiner

ARTICULATED STOCK FOR SHOULDER-FIRED WEAPON

TECHNICAL FIELD

The present invention concerns the field of shoulder-fired weapons, in particular assault rifles and sub-lethal weapons.

It concerns in particular an articulated stock intended to be integral with or fixed to the body of a weapon of this type.

The invention aims to enable optimum shooting by a user of shoulder-fired weapons when wearing a helmet with a visor or a gas mask.

PRIOR ART

A shoulder-fired weapon is a firearm that is held against the shoulder of a user before firing. The interface between the shoulder and the weapon is provided by a plate, commonly termed a butt plate.

In the field of firearms, new stocks, termed tactical stocks, have appeared. The function of these tactical stocks is to adjust the distance between the body or forestock of the weapon and the butt plate in order to adapt it to the morphology of the shooter.

Moreover, on these tactical stocks the shooter may be offered a supplementary cheek rest, in order to provide the shooter with more rest points to facilitate aiming and therefore firing.

There also exist butt plates on slides that are adjusted in height and in inclination over a few centimeters.

In France, the current protocol for use of firearms during assault phases by special forces or during public order maintaining missions obliges the operators to wear a helmet provided with a visor and to lower the latter to protect the face.

This has shown up a difficulty for the wearer of the helmet with the visor lowered in taking aim because the visor comes into contact with the stock, which obliges the shooter to adopt an uncomfortable position, or even to fold the stock on specific weapons such as that commercially designated by the reference G36 from the company HK or the 40×46 LBD (in French: Lanceur de Balles de Défense) from the company BRÜGER & THOMET.

The bulk of the visor modifies and disturbs aiming by the shooter because of defective parallax with the visor, unlike shooting without a visor.

No tactical stock existing at present enables this problem to be solved effectively.

The patent FR735860 describes a device enabling modification of the downward inclination of a stock relative to the forestock of the weapon, in order to aim without needing to raise the head out of the trench, aiming being effected with the aid of a periscope. The stock is articulated about a shaft, in order to adjust it to the correct height, and the butt plate or butt pad must be adjusted manually in order to re-establish its verticality.

The patent FR679450 discloses a shoulder stock for hunting rifles or military rifles, the stock being articulated to the body of the weapon by means of two butt pads separated from each other by a rigid part.

These very old devices are not at all suited to a modern shooting situation because they necessitate inconvenient adjustments that are impossible to carry out in practice in the time required for shooting by a user in an assault phase or a public order maintaining mission.

The patent application US 2008/0000132 A1 describes a stock in the form of a rigid extension fixed to the body of the weapon and offset laterally relative to the forestock of the weapon, in order to aim when wearing a helmet. This stock is in no way practical in use and leaves no freedom for adaptation to the morphology of the shooter.

The patent EP1126231B1 describes an articulated device that comes to be fixed to the body of a hunting rifle to enable adjustment of the angle and the height of the butt plate. This device, which claims to be as compact as possible, cannot in fact be fitted to an assault rifle or LBD and, in any case, in no way resolves the inconvenience caused by wearing a helmet with a visor when shooting.

The patent application EP2988087 also discloses a mechanism that is provided to offset the butt plate laterally relative to the body of the weapon, but with no possibility of adjusting the height or the inclination relative to the latter. The proposed mechanism therefore has the same disadvantages as that from the application US2008/000132.

There is therefore a need to find a simple solution that is rapid to implement, that enables a user of a shoulder-fired weapon to find their optimum position even when that user is wearing a helmet with a visor in the lowered position or a gas mask, in particular in order to avoid any parallax defect when shooting when wearing a visor.

The object of the invention is to address this need at least in part.

SUMMARY OF THE INVENTION

To this end, in one of its aspects, the invention concerns a stock for a shoulder-fired weapon, comprising:

- an articulated trapezoidal or parallelogram-shaped structure, including:
  - two blocks respectively forming a rest interface with the body of the weapon and a support for a butt plate, and
  - at least two rigid connecting arms each articulated, at one of its ends, by a pivot connection with the rest interface with the body of the weapon and at the other of its ends by a pivot connection with the support of the butt plate;
- at least one locking means for locking the arms together, in at least one fixed position defining a desired height of the butt plate relative to the rest interface.

Thus, the invention essentially consists in a stock articulated by means of an articulated parallelogram or trapezium mechanism defining different positions of the butt plate in terms of angle and height relative to the body of the weapon, it being possible to lock the stock in any of these positions.

The various pivot connections therefore make it possible to modify the angle and the height of the stock relative to the forestock of the weapon, at the same time as guaranteeing the optimum angle of the butt plate for the shooter.

Thanks to the invention, a shooter wearing a helmet with a visor in the lowered position is able to shoot without being impeded.

In other words, the articulated stock according to the invention enables a shooter to modify easily the height and the inclination of the butt plate relative to the body of the weapon and thus to continue to wear a helmet with the visor lowered, with the head upright, without their aim being impeded.

At least one of the rigid connecting arms advantageously includes curvatures toward the interior of the structure, so as to partially overlap one another. Connecting arms with optimized curved shapes therefore make it possible to optimize the passage of the visor of the helmet of the shooter in its lowered position.

According to one advantageous embodiment, at least one of the rigid connecting arms supports the at least one locking means in a fixed position.

According to this embodiment and according to a first variant embodiment, one of the rigid connecting arms includes a lead screw onto which a knurled nut is screwed, the other of the rigid connecting arms being provided with a slot in which the knurled nut is housed, enabling locking in the desired fixed position.

According to a second variant embodiment:

at least one of the arms is provided with a slot that substantially espouses the shape of its curvature and in the median part of said arm;

at least one other arm is provided with a shaft housed in the slot that is the locking shaft of a locking element for locking the arms by clamping.

The slot is advantageously provided with a plurality of detents in each of which the shaft can come to be housed, thus defining a position locking the stock in one of the fixed positions.

According to a variant embodiment, the stock comprises three arms of which two identical arms sandwich the other arm provided with the slot and where applicable with the locking detents.

The locking element is advantageously either a cam lever fixed, preferably screwed, to the locking shaft, or a knurled wheel screwed onto the locking shaft.

The length L of the rigid connecting arms and the length l between the axes of the pivot points of the pivot connection with the rest interface with the body of the weapon and of the pivot connection with the support of the butt plate advantageously satisfy the following condition: $\frac{1}{6}<l/L<\frac{1}{2}$. With these ratios, the ergonomics of the stock are optimized.

To optimize even more the ergonomics of the stock, the radius of curvature of the slot is substantially equal to the length l between the axes of the pivot points.

According to one advantageous embodiment, the rest interface with the body of the weapon comprises a pivot hinge adapted to enable lateral folding of the stock against the body of the weapon. This therefore makes it possible to make the weapon more compact when the shooter is not in a shooting configuration.

The stock according to the invention may comprise an elastomer butt plate fixed to or molded in one piece with the support.

The invention also concerns a shoulder-fired weapon comprising a stock that has just been described, the rest interface being integral with the body of the weapon or fixed to the body of the weapon.

DETAILED DESCRIPTION

Other advantages and features of the invention will emerge more clearly on reading the detailed description of embodiments of the invention given by way of nonlimiting illustration with reference to the following figures, in which.

Figure 5:
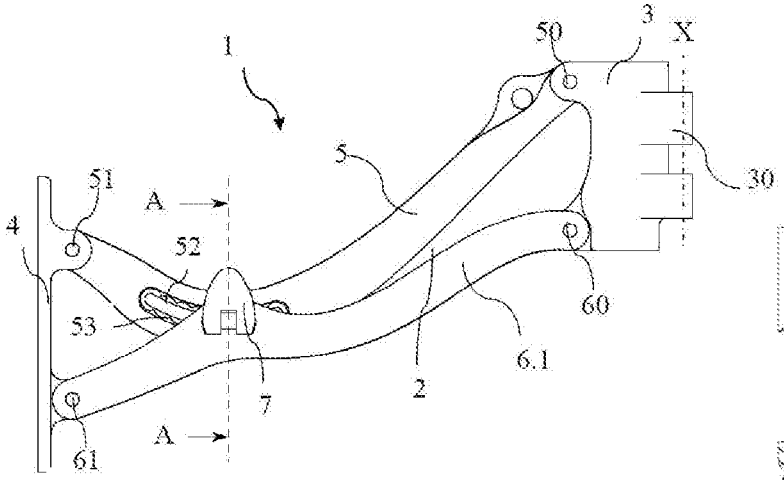
FIG. 5 is a side view of the stock according to FIG. 4.
Figure 5A:
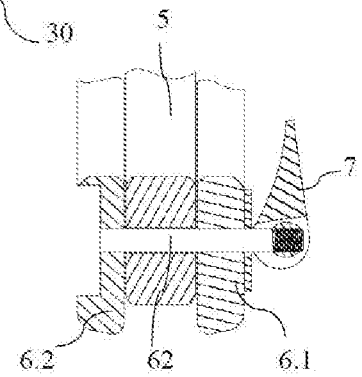
Figure 6:
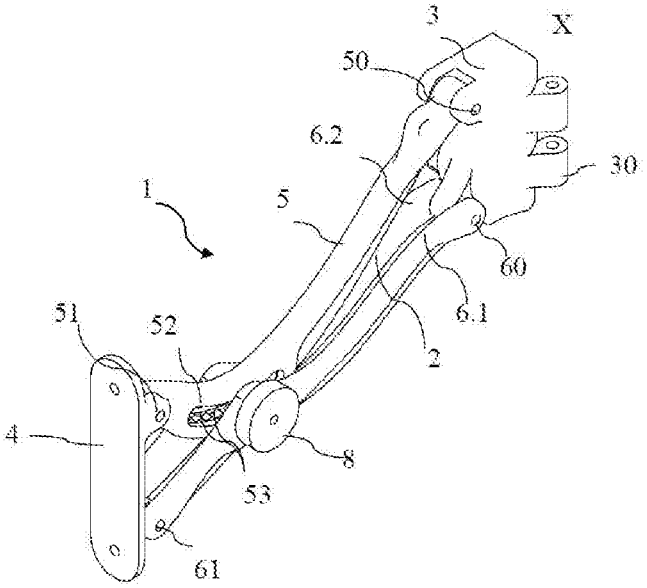
Figure 7:
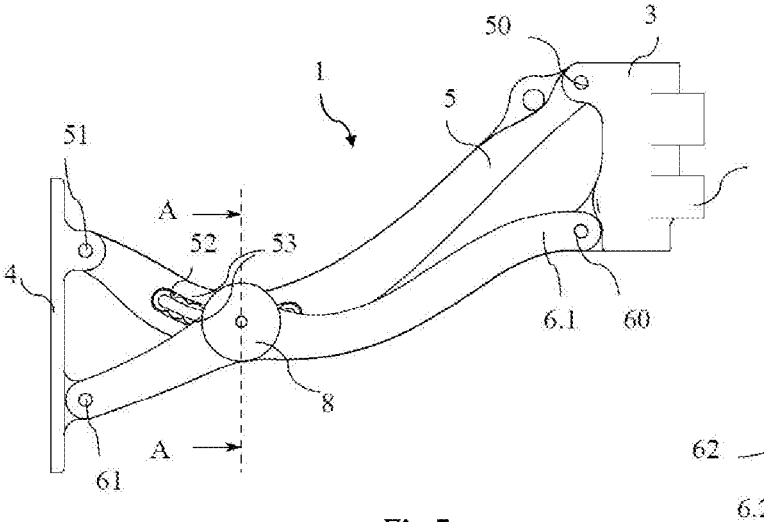

FIG. 5A a view in section taken along the line A-A in FIG. 5;

FIG. 6 is a perspective view of a third example of an articulated stock according to the invention for a shoulder-fired weapon, FIG. 6 showing the stock locked in an intermediate deployment position by clamping it by means of a knurled wheel;

FIG. 7 is a side view of the stock according to FIG. 6; and

Figure 7A:
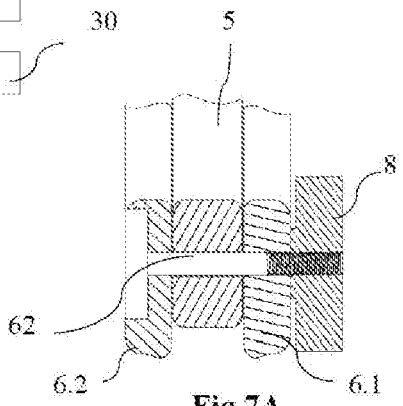

FIG. 7A is a view in section taken along the line A-A in FIG. 7.

In the various examples of the invention, the same elements of the stock are designated by the same reference numbers.

Figure 1:
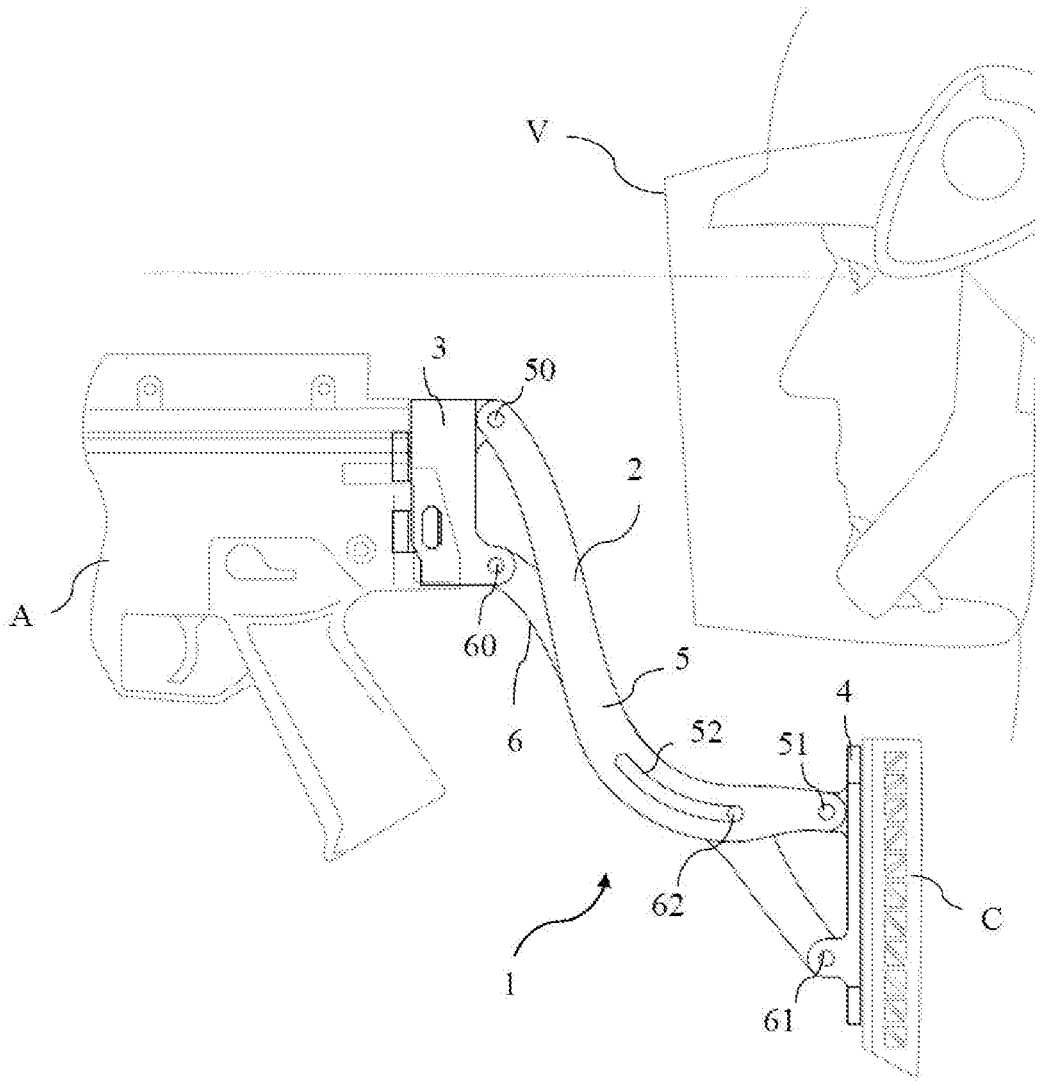
FIG. 1 is a side view of a first example of an articulated stock according to the invention for a shoulder-fired weapon, FIG. 1 showing the stock in its fully deployed position.

FIG. 1 shows an articulated stock according to the invention in a fully deployed position, mounted on a body (A) of a firearm with a user wearing a helmet with a visor in the lowered position.

The stock 1 according to the invention comprises a structure 2 constituted firstly of two blocks 3, 4 respectively forming a rest interface with the body (A) of the weapon and a support for a butt plate (C).

A first rigid connecting arm 5 is articulated at one of its ends by a pivot connection 50 with the rest interface 3 and at the other of its ends by a pivot connection 51 with the support 4 of the butt plate (C).

A second rigid connecting arm 6 is articulated at one of its ends by a pivot connection 60 with the rest interface 3 and at the other of its ends by a pivot connection 61 with the support 4 of the butt plate (C).

Thus, the structure 2 has two supports 3, 4 articulated to each other by two connecting arms 5, 6 by means of pivot connections 50, 51; 60, 61 forming an articulated parallelogram or trapezium mechanism.

Also, according to the invention, there is provided at least one locking means for locking the arms together, in at least one fixed position defining a desired height of the butt plate (C) relative to the rest interface. Because the butt plate (C) pivots completely on the support 4, it pivots on its own and of itself adapts to the shape and position of the shoulder of the shooter.

Figure 2:
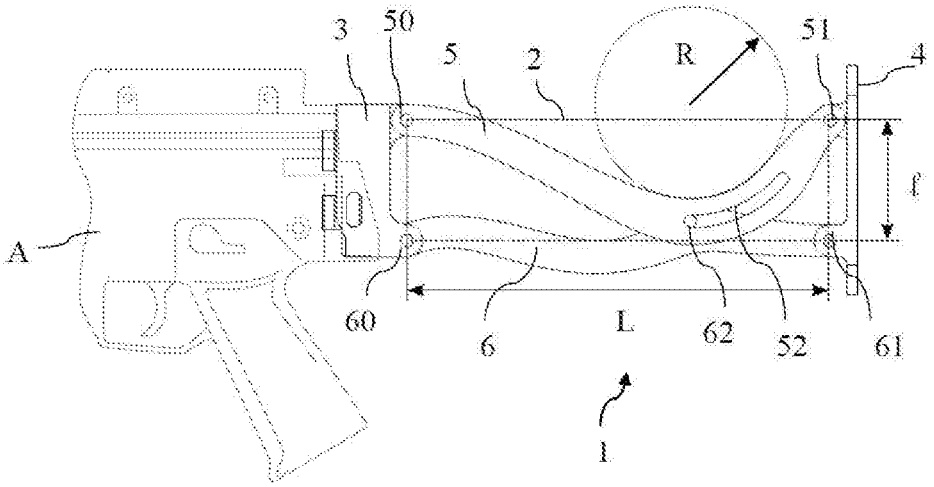
FIG. 2 is a side view of the stock according to FIG. 1, but in its fully folded position.

In the example from FIGS. 1 and 2, the locking means is constituted by a locking element for locking the arms by clamping them, described in detail hereinafter, the locking shaft 62 of which is supported and retained by an arm 6 and comes to be housed in a slot 52 formed in the median part of the other arm 5.

As shown in FIG. 1, the connecting arms 5, 6 have curved shapes optimized so as to optimize the passage of the visor V of the helmet of the shooter to its lowered position.

To be more precise, the curvatures of the arms 5, 6 are directed toward the interior of the structure so that they partially overlap one another.

In this configuration, locking is facilitated by a slot 52 with a shape that substantially espouses the shape of the curvature (R) of the arm 5 in which it is produced.

To optimize the ergonomics of the stock, the length L of the connecting arms 5, 6 and the length l between the axes of the pivot points of the pivot connection with the rest interface with the body of the weapon and of the pivot connection with the support of the butt plate satisfy the following condition: $\frac{1}{6}<l/L<\frac{1}{2}$.

To optimize even more the ergonomics of the stock, the radius of curvature R of the slot 52 is substantially equal to the length l between the axes between the pivot points 50, 60 and 51, 61.

Figure 3:
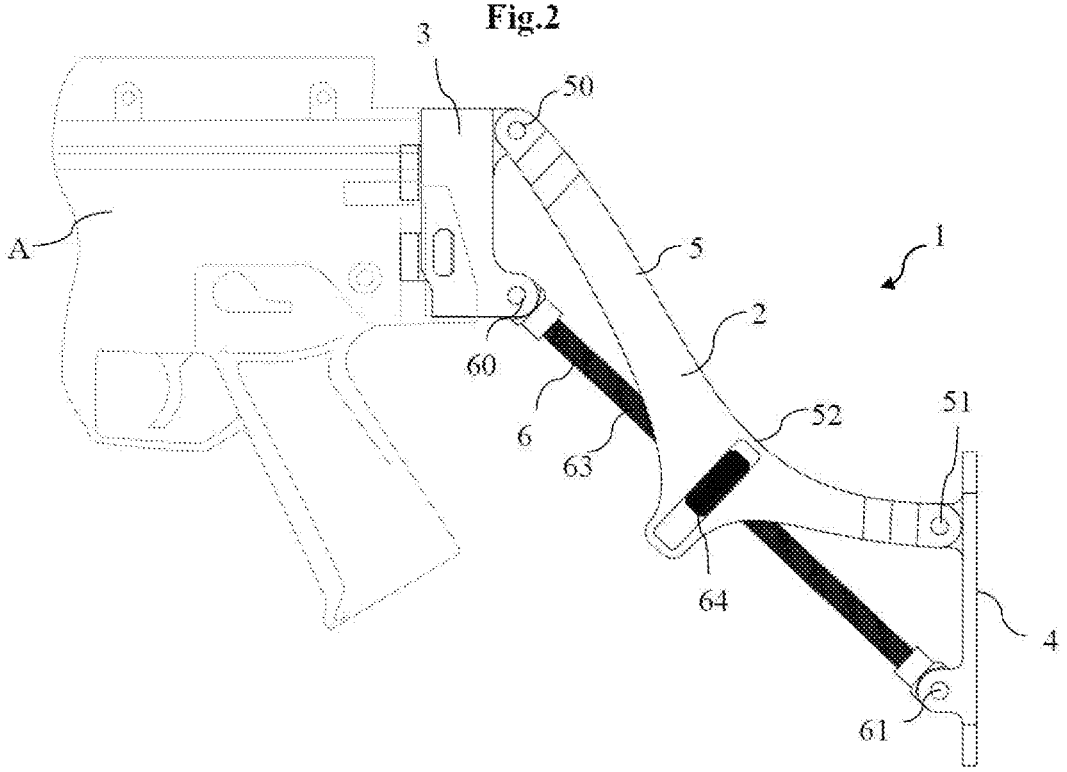
FIG. 3 is a side view of a second example of an articulated stock according to the invention for a shoulder-fired weapon, FIG. 3 showing the stock locked in an intermediate deployment position.

FIG. 3 shows another example of locking one of the rigid connecting arms 6 constituted of a lead screw 63 onto which is screwed a knurled nut 64 that is housed in the slot 52 to enable locking in the desired fixed position. Thus, screwing the knurled nut in or out modifies and at the same time locks the deformation of the parallelogram or trapezium 2 and therefore the position of the support 4 relative to the rest interface 3 and thus of the butt plate (C) relative to the body of the weapon (A).

As shown in FIGS. 4 to 7A, the articulated structure 2 may comprise two identical arms 6.1, 6.2 that sandwich the arm 5 in which the slot 52 is formed.

Figure 4:
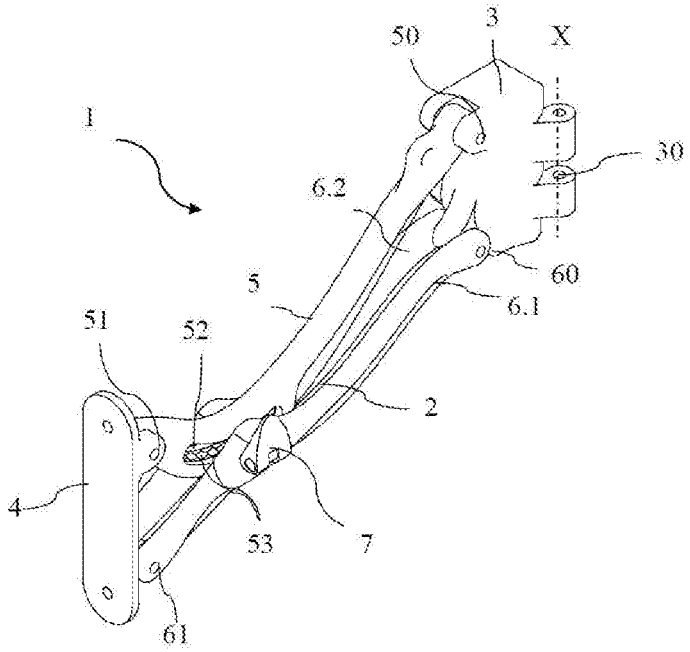
FIG. 4 is a perspective view of a third example of an articulated stock according to the invention for a shoulder-fired weapon, FIG. 4 showing the stock locked in an intermediate deployment position by clamping it by means of a cam lever.

The locking element may be constituted by a cam lever 7 that is screwed onto the shaft 62 that is itself supported on and retained in one of the exterior arms 6.1 and that the user has to fold against the other of the exterior arms 6.1 to clamp them together and therefore to lock the butt plate in one of its positions relative to the rest interface 3 with the body of the weapon (A) (FIGS. 4 to 5A).

Alternatively, there may be provided instead and in place of the cam lever 7 a clamping knurled wheel 8 screwed onto the shaft 62 (FIGS. 6 to 7A). Screwing in the knurled wheel 8 brings about the clamping of the arms 6.1, 5, 6.2 against one another and therefore the locking of the butt plate in one of its positions relative to the rest interface 3 with the body of the weapon (A).

To enable easier position adjustment and locking for the user of a weapon equipped with the stock 1, the slot 52 may be produced with a plurality of detents 53 each of which can accommodate the locking shaft 62.

As shown in FIGS. 4, 5, 6 and 7, the rest interface 3 with the body of the weapon may comprise a pivot hinge 30.

Using this hinge 30, the articulated stock 1 according to the invention is able to pivot about the axis X and therefore come to be folded against the body of the weapon to which it is fixed. This makes it possible to make the weapon more compact and easier to manipulate/transport.

Other variants and advantages of the invention may be produced without this departing from the scope of the invention.

In all of the examples shown, the distance between the axes between the pivot points 50, 60 of the rest interface 3 with the body of the weapon is equal to that between the pivot points 51, 61 of the support 4 of the butt plate. It may very well be envisaged that these two distances between axes have different values.

The invention is not limited to the examples that have just been described; in particular features of the examples shown may be combined with one another in variants that are not shown.

The invention claimed is:

1. A stock for a shoulder-fired weapon (A), comprising:

an articulated trapezoidal or parallelogram-shaped structure, including:

two blocks respectively forming a rest interface with a body (A) of the weapon and a support for a butt plate (C), and at least two rigid connecting arms each articulated, at one of its ends, by a pivot connection with the rest interface with the body (A) of the weapon and at the other of its ends by a pivot connection with the support of the butt plate (C), the articulated trapezoidal or parallelogram-shaped structure making it possible to modify the angle and the height of the butt plate (C) relative to the body (A) of the weapon;

at least one locking means for locking the arms together, in at least one desired fixed position defining a desired height of the butt plate relative to the rest interface.

2. The stock for a shoulder-fired weapon (A) as claimed in claim 1, wherein at least one of the rigid connecting arms includes curvatures toward the interior of the structure, so as to partially overlap one another.

3. The stock for a shoulder-fired weapon (A) as claimed in claim 1, wherein at least one of the rigid connecting arms supports the at least one locking means in a fixed position.

4. The stock for a shoulder-fired weapon (A) as claimed in claim 3, wherein one of the rigid connecting arms includes a lead screw onto which a knurled nut is screwed and the other of the rigid connecting arms is provided with a slot in which the knurled nut is housed, enabling locking in the desired fixed position.

5. The stock for a shoulder-fired weapon (A) as claimed in claim 3, wherein:

at least one of the arms is provided with a slot that substantially espouses a shape of its curvature (R) and in a median part of said arm;

at least one other arm is provided with a shaft housed in the slot that is a locking shaft of a locking element for locking the arms by clamping.

6. The stock for a shoulder-fired weapon (A) as claimed in claim 5, wherein the slot is provided with a plurality of detents in each of which the shaft can come to be housed, thus defining a position locking the stock in one of the fixed positions.

7. The stock for a shoulder-fired weapon (A) as claimed in claim 5, comprising three arms of which two identical arms sandwich the other arm provided with the slot.

8. The stock for a shoulder-fired weapon (A) as claimed in claim 5, wherein the locking element is a cam lever fixed, to the locking shafts.

9. The stock for a shoulder-fired weapon (A) as claimed in claim 5, wherein the locking element is a knurled wheel screwed onto the locking shaft.

10. The stock for a shoulder-fired weapon (A) as claimed in claim 1, wherein the length L of the rigid connecting arms and the length l between the axes of the pivot points of the pivot connection with the rest interface with the body of the weapon and of the pivot connection with the support of the butt plate satisfying the following condition: $\frac{1}{6}<l/L<\frac{1}{2}$.

11. The stock for a shoulder-fired weapon (A) as claimed in claim 10, wherein a radius of curvature (R) of the slot is substantially equal to the length l between the axes of the pivot points.

12. The stock for a shoulder-fired weapon (A) as claimed in claim 1, wherein a rest interface with the body (A) of the weapon comprises a pivot hinge adapted to enable lateral folding of the stock against the body of the weapon.

13. The stock for a shoulder-fired weapon (A) as claimed in claim 1, comprising an elastomer butt plate (C) fixed to or molded in one piece with the support.

14. A shoulder-fired weapon (A) comprising a stock as claimed in claim 1, wherein the rest interface is integral with the body of the weapon or fixed to the body of the weapon.

* * * * *